United States Patent [19]

Furuichi

[11] 4,333,012

[45] Jun. 1, 1982

[54] AUTOMATIC BLACKENING DEGREE ADJUSTMENT SYSTEM

[75] Inventor: Shuhei Furuichi, Kyoto, Japan

[73] Assignee: Kabushiki Kaisha Morita Seisakusho, Kyoto, Japan

[21] Appl. No.: 189,755

[22] Filed: Sep. 23, 1980

Related U.S. Application Data

[63] Continuation of Ser. No. 728,059, Jul. 26, 1978, abandoned.

[30] Foreign Application Priority Data

Jul. 30, 1977 [JP] Japan ..... 52-091795

[51] Int. Cl.[3] ..... H05G 1/32

[52] U.S. Cl. ..... 250/409; 250/322; 250/439 P; 250/355

[58] Field of Search ..... 250/439 P, 409, 322, 250/355

[56] References Cited

U.S. PATENT DOCUMENTS 2,401,289 5/1946 Morgan et al. ..... 250/355
2,913,582 11/1959 Collins et al. ..... 250/409
4,063,099 12/1977 Grassme ..... 250/402

FOREIGN PATENT DOCUMENTS 2351473 4/1975 Fed. Rep. of Germany ..... 250/322
2309112 11/1976 France ..... 250/409

*Primary Examiner*—Alfred E. Smith
*Assistant Examiner*—T. N. Grigsby
*Attorney, Agent, or Firm*—Koda and Androlia

[57] ABSTRACT

An automatic blackening degree adjustment system which includes the steps of making a fluorescent plate luminous by a residual dose of X-rays that have penetrated the person to be photographed and an X-ray film, converting the amount of luminescense into electric output, converting the relative feed speed of an X-ray film with respect to an X-ray beam into electric output and computing an electric output obtained from the conversion of amount of luminescense and the relative feed speed and feeding back a value obtained to a filament control circuit to thereby control the filament current of the X-ray machine whereby the tube voltage of the X-ray tube is kept constant so that the exposure is adjusted to an optimum amount with the X-ray wave length kept constant and resulting in X-ray photograph taken which have sufficient and uniform contrast in any part thereof.

1 Claim, 8 Drawing Figures

AUTOMATIC BLACKENING DEGREE ADJUSTMENT SYSTEM

This is a continuation of application Ser. No. 728,059 filed July 26, 1978 now abandoned.

BACKGROUND OF THE INVENTION

1. Field of the Invention

This invention relates to a system of electrically making automatic adjustment of the blackening degree of an X-ray photograph obtained by X-ray photograph.

2. Prior Art

The quality of an X-ray photograph obtained by an X-ray phtographing apparatus depends upon the good or bad balance between the individual conditions of a person to be photographed, the tube current, and the tube voltage of an X-ray tube. This good or bad balance is judged by the blackening degree of the X-ray photograph. Particularly, in X-ray photographing in dental treatment, there is provided a variation in the dose of X-rays which reach the surface of the film because of differences between adults and children, between sexes and between front teeth, false teeth and true molars even if the teeth are those of the same person to be photographed. Even though a good contrast is obtained in certain parts of the film, it happens that a good contrast cannot be obtained in other parts because of wide deviation of the film in blackening degree from an optimum value. In the prior art, to solve this problem, the illuminance has been adjusted by adjusting the tube voltage. This is not an advantageous method because the change in voltage by such adjustment provides a change in wave length of the X-rays, particularly when the tube voltage is lowered and as the wave length is increased the X-rays are absorbed by the soft part of the patient's mouth region.

SUMMARY OF THE INVENTION

Accordingly, it is a general object of the present invention to provide an automatic blackening degree adjustment system which does not change the frequency of the X-rays.

In keeping with the principles of the present invention, the objects are accomplished by a unique automatic blackening degree adjustment system. The automatic blackening degree adjustment system includes the steps of making a fluorescent plate luminous by residual dose of X-rays that have penetrated a person to be photographed and an X-ray film, converting the amount of luminescense from the fluorescent plate into an electric output, converting the relative feed speed of an X-ray film with respect to X-ray beams into an electric output and computing an electric output from the conversion of the amount luminescense and the relative feed speed and feeding back the electric output obtained to a filament current control circuit to thereby control the filament current whereby the tube voltage of the X-ray tube is kept constant and the X-ray wave length is kept fixed while the exposure is adjusted to an optimum amount with the final result that the X-ray photograph taken has sufficient and uniform contrast in any part thereof.

BRIEF DESCRIPTION OF THE DRAWINGS

The above-mentioned features and objects of the present invention will become more apparent with reference to the following description taken in conjunction with the accompanying drawings, wherein like reference numerals denote like elements, and in which:

FIGS. 3(A) through 3(F) are wave-form diagrams respectively illustrating the operation of each unit in FIGS. 1 and 2 and wherein FIG. 3(A) illustrates AC voltage wave form inputted to terminals a and b; FIG. 3(B) the X-ray tube anode current wave form; FIG. 3(C) the output current wave form of low-speed tachometers; FIG. 3(D) the computed value current wave form; FIG. 3(E) the trigger current wave form; and FIG. 3(F) illustrates the filament current wave form.

DETAILED DESCRIPTION OF THE INVENTION

Figure 1:
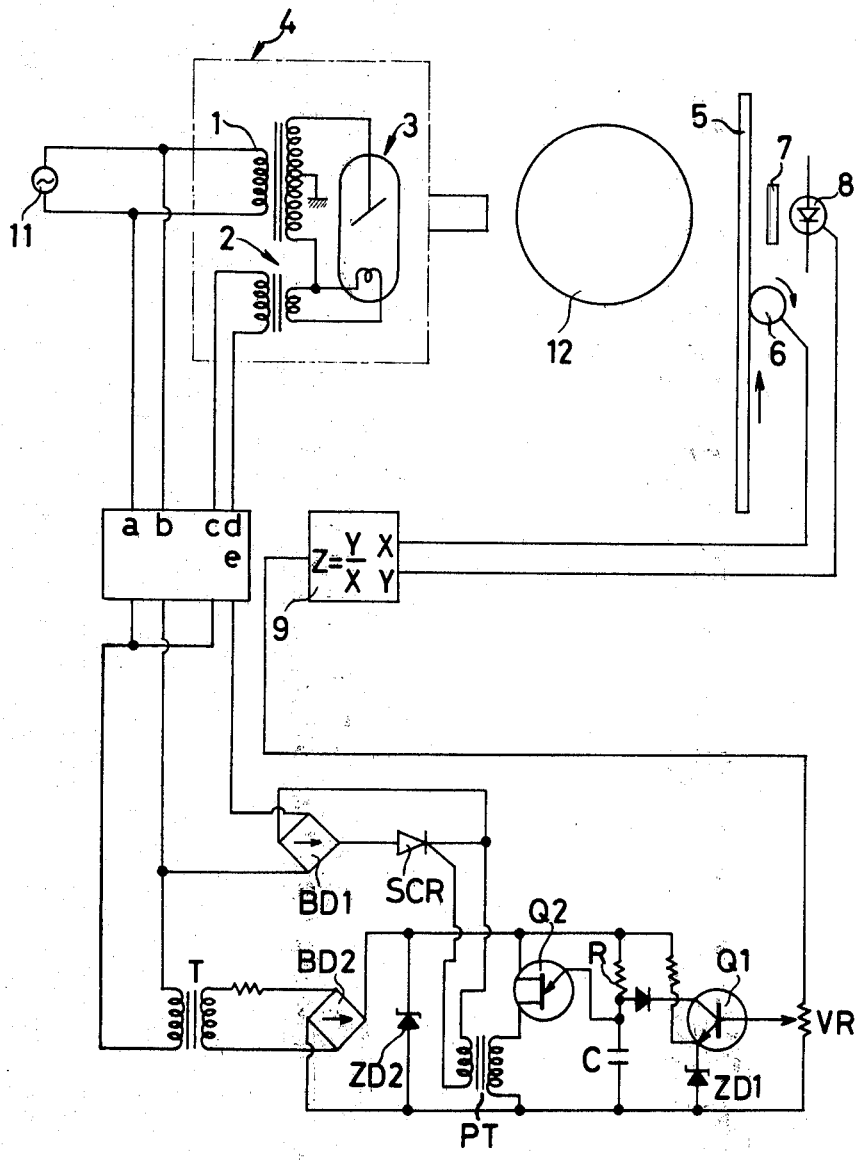
FIG. 1 is a schematic block diagram of a panoramic X-ray photographing apparatus with an automatic blackening degree adjustment system for dental treatment in accordance with the present invention.
Figure 2A:
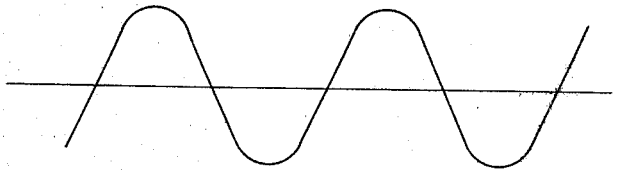
FIG. 2 is a circuit diagram illustrating one embodiment of a filament current control circuit in FIG. 1.
Figure 2B:
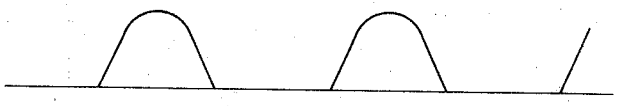
Figure 2C:
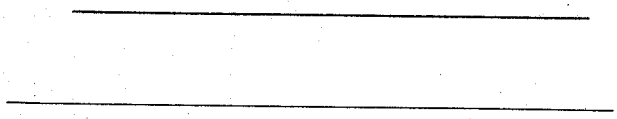
Figure 2D:
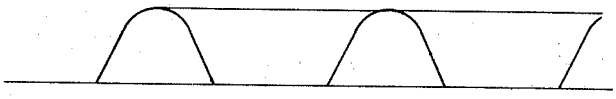
Figure 2E:
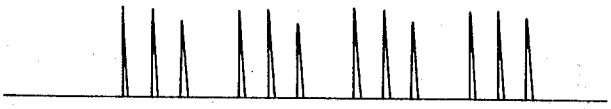
Figure 2F:
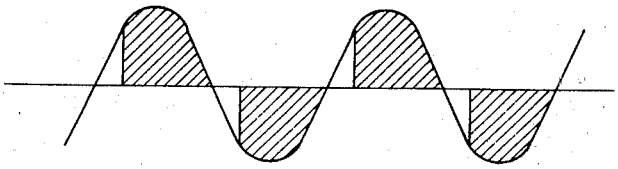

Referring more particularly to the drawings, shown in FIG. 1 is a panoramic X-ray photographing apparatus with an automatic blackening degree adjustment system in accordance with the teaching of the present invention. In FIG. 1, the panoramic X-ray photographing apparatus includes a high-voltage transformer 1, a filament transformer 2 and an X-ray tube 3 contained in an X-ray head 4. An X-ray film 5 is disposed in corresponding relationship with respect to the head 4 and a low speed tachometer 6 for measuring the feed speed of the film 5 and outputting the total feed speed as an electric signal is provided. A fluorescent plate 7 exhibiting fluorescence when struck by X-rays that have penetrated the film 5 is provided behind the film 5 and a photoelectric converter 8 for outputting an electric signal corresponding to the luminous intensity of the fluorescent plate 7 is provided adjacent the fluorescent plate 7. A computing circuit 9 whose inputs are the outputs of the low speed tachometer 6 and the photoelectric converter 8 is provided. In the computing circuit 9, the output of the low speed tachometer 6 is the X input of the computing circuit 9 and the output of the photoelectric converter 8 is the Y input of the computer circuit 9 and the output Z of the computing circuit 9 is generated by dividing the Y signal by the X signal. The output of the computing signal 9 is supplied to the filament control circuit 10 which includes input terminals a and b, an input terminal e and output terminals c and d. The output terminal c and d are connected to the primary side of the filament transformer 2 and the input terminals a and b are supplied power from AC power 11 which is supplied to the primary side of the high voltage transformer 1. The input terminal e is supplied with the output Z of the computing circuit 9.

In operation, X-rays radiated from the head 4 to the film 5 and pass through the person 12 to be photographed. The X-rays penetrate the tooth region of the person 12 and expose the film 5 to form an image of the tooth region on the film 5. In addition, residual dose of X-rays that has penetrated the film make the fluorescent plate 7 luminous. Because of this luminous intensities proportional to the intensity of the X-rays, the photoelectric converter 8 outputs an electrical signal responsive to the intensity of the X-rays. At the same time, because the film is moved forward by feed means (not shown) for panoramic photographing, the low-speed tachometer 6 measures this feed speed of the film and outputs in an electric signal. These two outputs are supplied to the computing circuit 9 and the computed output Z is inputted to the filament control circuit 10. By means of the filament control circuit 10, feed control is made of the filament transformer 2 on the basis of the value Z so as to make value Z always fixed.

Referring to FIG. 2, shown therein is a circuit diagram of a filament current control circuit 10 utilized in the embodiment of FIG. 1. The filament current control circuit 10 includes a power transformer T, bridge rectifiers BD1 and BD2, a thyristor SCR, constant voltage diodes ZD1 and ZD2, a transistor Q1, a unijunction transistor Q2 forming a step oscillator together with resistor R and condenser C, a variable register VR for varying the base bias of the transistor Q1 and a pulse transformer PT for the gate trigger. AC voltage shown in FIG. 3(A) is inputted to the input terminals a and b. The X-ray tube anode current is illustrated in FIG. 3(B).

As discussed above, the output of the photoelectric converter 8 and the output current of the low-speed tachometer (FIG. 3(C)) are inputted to the computing circuit 9 and the computed value Z (current shown in FIG. 3(D)) is applied to the input terminal e. Accordingly, bias is applied to the base of transistor Q1. This base bias is compared with voltage across a constant-voltage diode ZD1 and when the base bias is low, the transistor Q1 becomes deenergized and the unijunction transistor Q2 oscillates at a self-oscillating frequency that is set by the resistor R and condenser C. Conversely, when bias is high, transistor Q1 is energized and hence the charging speed of condenser C is reduced and the oscillating frequency of the unijunction transistor Q2 drops. In short, when the base bias is low, the intervals at which a trigger current (FIG. 3(E)) enters from the pulse transformer PT to the gate of thyristor SCR is enlarged thereby increases the period of time of energization from the On-period to the Off-period of the thyristor SCR; and when the base bias is high, the intervals of the tirgger current is reduced and the period of energization from the On-period to the Off-period of the thyristor SCR is reduced. Accordingly, the current flowing from the output terminals c and d to the filament transformer 2 is varied. In response to the output of output terminals c and d, a filament current (FIG. 3 (F)) is placed under phase control with the result of the tube current is controlled and the computed value Z is kept constant. Also, when the variable resistor VR is set such that when the computed value Z is indicated at a most desirable value the base bias become equal to the voltage across the constant voltage diode ZD1, the whole system constitutes a feedback loop. Accordingly, the value Z becomes always a constant and an optimum contrast can be maintained.

As described above, the system according to the teachings of the present invention is a system under which the residual dose of X-rays that has penetrated the person to be photographed and the X-ray film and the relative feed-speed of the X-ray film with respect to X-ray beams are measured and computed and the filament current is controlled on the basis of the value obtained by a computation and the tube current is varied in response to the control circuit. Accordingly, this system makes it possible to keep the tube voltage of the X-ray tube always constant, which in turn makes it possible to adjust the exposure to an optimum amount with the X-ray frequency remaining a fixed value. For these reasons, the X-ray photograph obtained has a sufficient and uniform contrast in any part thereof.

It should be apparent to those skilled in the art that above-described embodiment is merely illustrative of but one of the many possible specific embodiments which represents the application of the principles of the present invention. Numerous and varied other arrangements can be readily devised by those skilled in the art without departing from the spirit and scope of the invention.

I claim:

1. An automatic blackening degree adjustment system in an X-ray machine of the type including a source of X-rays which generates an X-ray beam, X-ray film provided opposite the X-ray source, a means for moving the X-ray film relative to the X-ray beam and an X-ray sensor behind the X-ray film, which comprises the steps of:

converting an X-ray intensity into a first electrical signal output;

measuring and converting a relative feed velocity of said X-ray film relative to said X-ray into a second electrical signal output;

feeding said first and second electrical signal outputs to a divider;

converting a quotient of said divider resulting from a division of said first signal by said second signal into a third electrical signal;

feeding said third electrical signal into a comparator and feeding back an output signal from said comparator to a filament control circuit of said X-raying machine thereby controlling filament current of said X-ray machine whereby a tube voltage of an X-ray tube is kept constant for photographing intervals such that exposure is adjusted to an optimum amount while the X-ray wavelength is kept constant and resulting in X-ray photographs which have sufficient and uniform contrast in all part thereof.

* * * * *